US005921895A

United States Patent [19]

Lynch et al.

[11] Patent Number: 5,921,895

[45] Date of Patent: Jul. 13, 1999

[54] MARTIAL ARTS STRIKING DEVICE

[76] Inventors: John R. Lynch, 4822 Valla Rd, Louisville, Ky. 40213; Thomas G. Coleman, 3207 Poplar Level Rd, Louisville, Ky. 40213

[21] Appl. No.: 09/016,032

[22] Filed: Jan. 30, 1998

[51] Int. Cl.[6] ..... A63B 69/00

[52] U.S. Cl. ..... 482/83; 482/87

[58] Field of Search ..... 482/83–90; 472/441–445

[56] References Cited

U.S. PATENT DOCUMENTS

| | | | |
|---|---|---|---|
| 615,700 | 12/1898 | Hess . | |
| 2,009,040 | 7/1935 | Beach . | |
| 3,427,021 | 2/1969 | Donato . | |
| 3,888,481 | 6/1975 | Adams, Jr. et al. | 482/83 |
| 4,662,630 | 5/1987 | Dignard et al. . | |
| 4,903,966 | 2/1990 | Liao | 482/90 |

*Primary Examiner*—Jerome Donnelly
*Attorney, Agent, or Firm*—Wheat, Camoriano, Smith & Beres, PLC

[57] ABSTRACT

A martial arts striking device using a pair of spaced and heavy duty spring assemblies with a top bracket having a centered opening for receiving an upright post supporting a resilient striking bag. The lower ends of the spring assemblies are secured to a bottom bracket, which is fastened to a firm footing such as a floor. The wire making up the springs are of such a diameter that the springs have a low spring constant, meaning the springs are highly resistive to impacts against the bag and will return to an upright position without undue oscillation.

7 Claims, 2 Drawing Sheets

MARTIAL ARTS STRIKING DEVICE

BACKGROUND OF THE INVENTION

This invention relates to a striking device for boxing and martial arts practice, and, more particularly, relates to a spring mounted striking device having directional and controlled resistance to striking forces applied to the device.

Striking or punching bags that are resiliently mounted are well known, as illustrated in U.S. Pat. No. 2,009,040 issued to Beach. The Beach reference is illustrative of an omnidirectional bag that can be punched from any direction and will oscillate in a plane of the direction in which the striking force is delivered. It promotes speed of delivery and timing, but not power. Large heavy punching bags, which are usually mounted by a single harness from an overhead support, largely represent the state of the art in providing power striking practice. Typically, such a bag is held in place by a partner to prevent swinging of the bag from repeated deliveries.

An example of a martial arts striking device is found in U.S. Pat. No. 4,662,630 issued to Dignard et al. Dignard teaches the use of a planar shaped striking object mounted over a retaining device that is secured to a bracket. The bracket is spaced apart from a second bracket by a pair of springs with the second bracket pivotally mounted to a wall rack secured to a vertical wall. The striking object can be angularly oriented with respect to the wall brace. When a "strike" is delivered as, for example, when the striking object is kicked, the device pivots, oscillates about the springs, and eventually returns to it initial position. The martial arts kicking device of the '630 patent is designed for practicing accurate kicking as opposed to "power strikes" and clearly requires considerable pivoting of the springs and subsequent oscillation thereof in an effort to promote accuracy. A "power strike" is defined for purpose of this invention as a punch or blow delivered for maximum impact against a target device.

The above devices do not focus upon the strengthening of the individual to deliver power strikes in actual combat and do not approximate an actual person to whom the power strike is to be delivered. It is therefore an object of the present invention to provide for a marital arts striking device that promotes power strikes as would be desired to be delivered in actual combat, does not require the presence of another party to hold the device steady for repeated deliveries, and rewards the accuracy of the power strike.

These and other objects will become readily apparent upon a reading of the description herein with the appended drawings.

SUMMARY OF THE INVENTION

The martial arts striking device of the present invention comprises a base plate adapted to be secured to a support surface, a support bracket having a centered opening, and a pair of spring assemblies having an upper and lower end. Each of the spring assemblies are secured at the upper end to the support bracket adjacent the centered opening and secured at the lower end to the base plate. An upright post extends downwardly through the opening in the support bracket and upwardly a predetermined distance above the support bracket. The post is secured against vertical movement with respect to the support bracket and a resilient bag is mounted at its upper end. The springs of the spring assembly have a maximum spring resistance and a significantly dampened oscillation so as to provide minimum oscillation in one direction and maximum oscillation in a second direction with quick upright response time, thereby providing a martial arts device promoting accurate power strikes by the practicing martial arts student.

DETAILED DESCRIPTION OF THE PREFERRED EMBODIMENT

Figure 1:
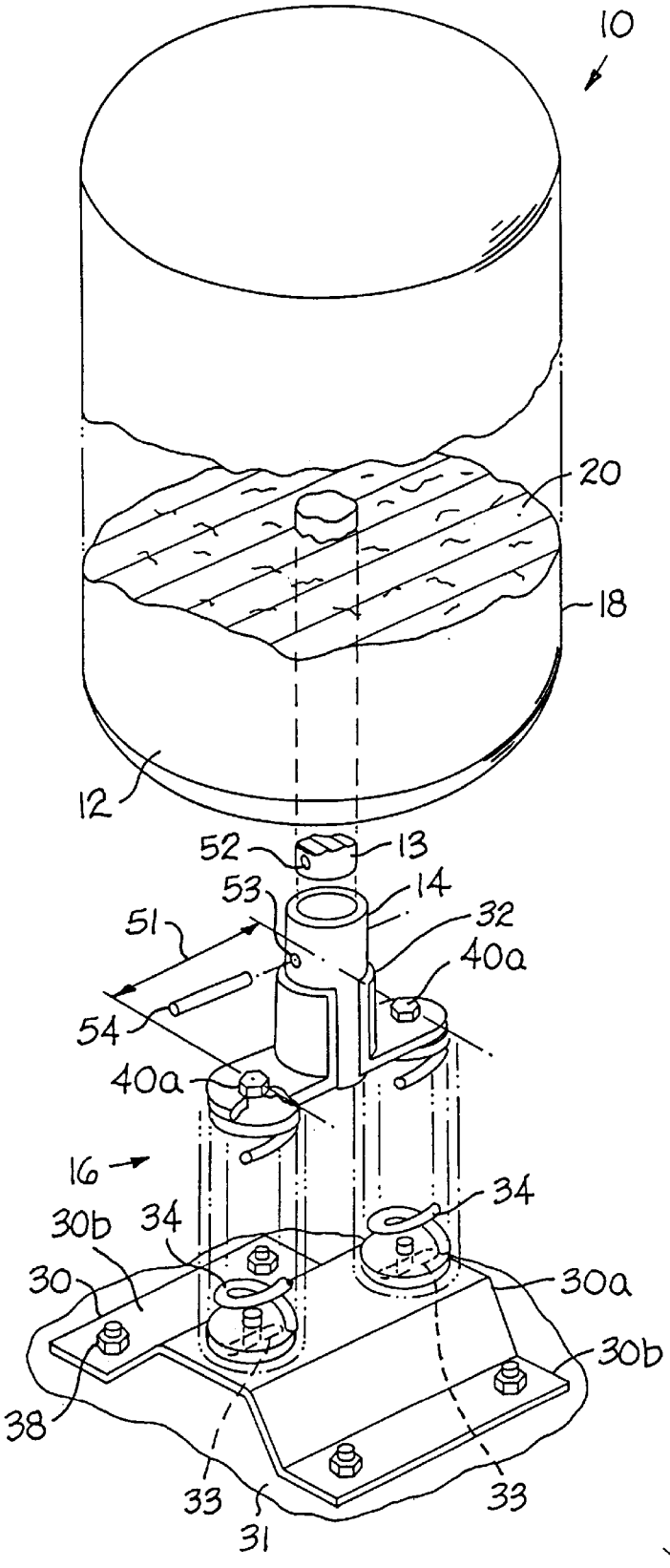
FIG. 1 is a perspective view of a martial striking device embodying the present invention, with portions broken away to show the interior of the bag and spring assembly.
Figure 2:
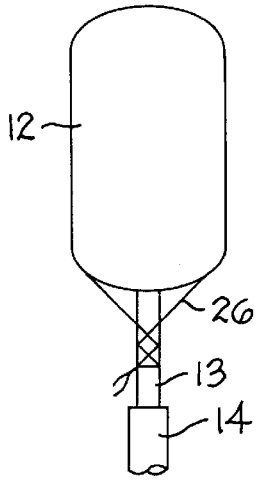
FIG. 2 is a schematic side view of the device of FIG. 1, illustrating the manner in which the bag is secured to the support post.
Figure 3A:
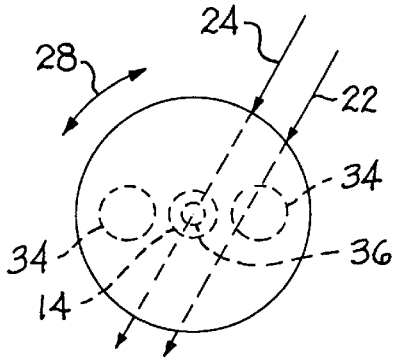
FIG. 3A is a schematic top view of the device of FIG. 1, illustrating the forces that can be delivered to the device and the slight rotation of the device when an off center strike is delivered.

Referring now to FIG. 1, the kicking device of the present invention is indicated generally by character numeral 10. The device 10 is generally comprised of a bag 12 that is releasably mounted on an adjustable post 13 that is secured to a bidirectional spring support structure, indicated generally by character numeral 16. The bag 12 has a covering 18, such as Herculite 180 (available from Derby City Fabric in Louisville, Ky.), which is capable of absorbing repeated blows from hands and feet over an extended period of time. The covering 18 is filled with any commercially available impact-resisting material 20. The bag 12 has a central cavity, extending from its lower end to a position short of its top, that is complimentary to the outer diameter of the post 13. Once positioned on the post 13, the bag 12 is secured to the post 13 in such a manner that it can move radially in a short arc with respect to the post 13 if a blow is delivered to the bag 12 generating a force passing "off center" of the bag 12. The "off center" force, depicted in FIG. 3A, is illustrated by arrow 22, while a force passing through the center is illustrated by arrow 24. The appropriate securing relationship that permits the restrained radial movement of the bag 12 relative to the post 13 can be accomplished by tying laces 26, which are stitched to the bottom of the covering 18, directly to and around the post 13, as shown in FIG. 2. The natural resiliency of the lacing allows radial movement of the bag several degrees in one direction or another, as indicated by arc arrow 28 (FIG. 3A), due to the torque generated by the off center force. This restrained radial movement is an important aspect of the present invention as it permits the bag to react in a more life-like manner, resembling the reaction of the body of a person receiving the glancing blow. A rigid connection between the bag 12 and the post 13 would prevent the bag from moving radially.

The spring assembly 16 comprises a lower support channel 30 and an upper post receiving member 14 preferably abutting or alternatively welded to a pair of support brackets 32. The channel 30 and the lower, horizontally disposed flange of the support brackets 32 are spaced apart by a pair of helical springs 34. A central opening 36 of the post receiving member 14, as best shown in dashed lines in FIGS.

3A and 3B, accepts the smaller diameter of the post 13. The support channel 30 is secured to the flooring or foundation 31 of the room in which device 10 is to be located in any appropriate manner, for example, using bolts and nuts 38. As perhaps best seen in FIG. 4, a spring securing bolt 40, having a head 40*a* and a threaded end 40*b* mounting a nut 42, is coaxially aligned with the longitudinal axis of the springs 34 at the ends of each spring 34. A spring washer 43 is mounted on each end of each spring 34. At the upper end of each spring 34, a bolt 40 passes through the bracket 32, through a spring washer 43, and is secured by a nut 42, thereby securing the bracket 32 against the upper end of the spring 34. Similarly, at the lower end of each spring 34, a bolt 40 passes through the raised portion of the channel 30*a*, through a spring washer 43, and is secured by a nut 42, thereby securing the channel 30 against the lower end of the spring 34. Although this method of securing the springs 34 to the channel 30 and bracket 32 is preferred, it is understood that other attachment means, such as a single bolt extending longitudinally through the center of each spring 34, may be used to secure the assembly.

Also, as a further refinement, it is preferred that holes 33, as shown in dashed lines in FIG. 1, be slotted along the length of the channel 30 to provide for finer adjustment of the spacing of springs 34 where the upper flanges of the bracket 32 are in an abutting relationship with the receiving member 14.

Figure 1A:
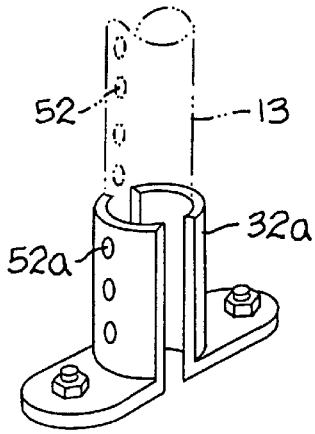
FIG. 1A is a perspective view of the upper portion of the spring assembly, illustrating a different structure for receiving the post of the bag.

It should be understood that while the preferred embodiment illustrates a pair of brackets 32 having curved upper flanges in an abutting relationship to a post receiving member 14, in some instances, it may be preferable, as illustrated in FIG. 1A, for the brackets 32*a* to form a circular opening to receive the post 13, thus eliminating the post receiving member. In such instances, the brackets 32*a* would be provided with openings 52*a* to register with the openings 52 in the post 13. Additionally, the upper flange portion of the brackets 32*a* could have a flat configuration.

The support channel 30 is preferably a steel channel bracket having a raised central body 30*a* to which the spring bolts 40 are secured and flanges 30*b* which are secured to the flooring 31. When the bag 12 is struck, the flexing of the central body 30*a* with respect to the flanges 30*b* assists in providing the desired dampening effect to the device 10.

The post 13 can be adjusted vertically through a typical pin and slot arrangement, as shown in FIG. 1, in which the post 13 and the post receiving member 14 are respectively provided with a plurality of vertically spaced slots 52 and 53, which, when registered, can receive a pin 54. Adjustment of the post 13 is effectuated by movement of the post 13 relative to the receiving member 14 and bracket 32, aligning the slots above the bracket 32, and inserting the pin 54 to fix the post 13 vertically relative to the member 14 and bracket 32.

Figure 4:
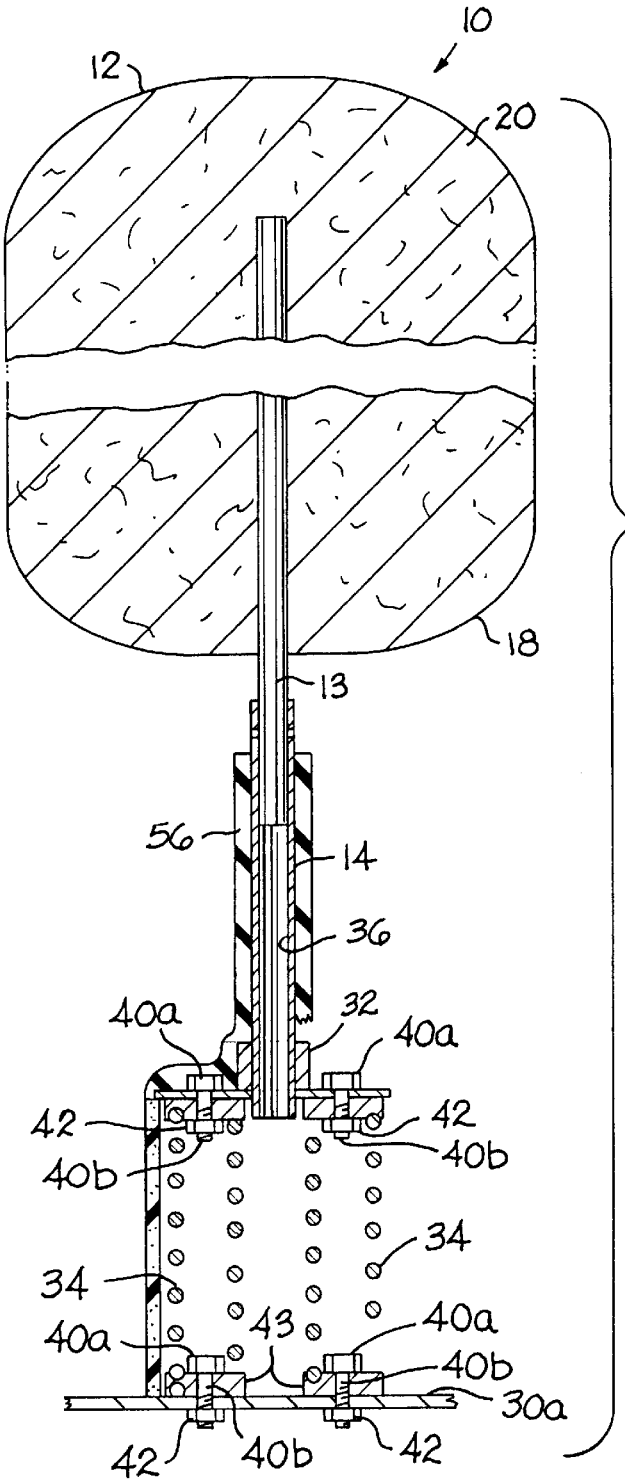
FIG. 4 is a side sectional view of the device of FIG. 1.

It may be seen in FIG. 4 that the entire exterior of the post 14 and spring assembly 16 is covered with a protective covering 56 to minimize contact between the user and the metal surfaces of the device. The covering 56 may consist of a foamed resin material such as a dense closed cell foamed polyolefin to absorb misdirected strikes and minimize injury to the martial arts student.

Figure 3B:
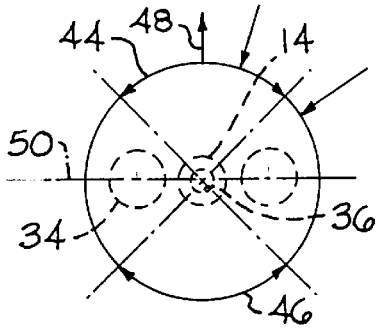
FIG. 3B is a schematic view, similar to FIG. 3, illustrating the magnitude of oscillation of the device from accurate strikes versus inaccurate strikes.

An important feature of the present invention is the selection of springs with the appropriate spring index; the spring index is defined as the diameter of the coil of the spring divided by the diameter of the wire. Generally speaking, the smaller the spring index, the greater will be the stiffness and load-bearing capability of the spring. The springs should be stiff enough to resist coiling due to off center blows, offer significant resistance to blows that are directed within front or rear 120°arcs 44, 46 measured from a point centered between the longitudinal axis of the springs 34 (as shown in FIG. 3B), and together with other components, have a "dampening response time period" of less than about 2 seconds. Basically, the dampening response time period is the time it takes for the bag to return to its motionless and upright position after being struck. Moreover, it is necessary that any blows coming from outside of the aforementioned 120°arc be absorbed to such an extent that there is little movement of the device 10 from it centered position. It is extremely desirable that the device have maximum oscillation in a direction shown by arrow 48 in FIG. 3B, which is a direction substantially perpendicular to a datum line 50 running perpendicular to the axis of the springs 34. This more effectively represents the natural reaction of a person facing the martial artist after a blow has been delivered, thereby training the student to deliver power blows, i.e., blows that come within the 120°arc.

It is also desirable that the bag return quickly to its upright position before all but the most advanced students can deliver consecutive strikes. To ensure that the device has this type of motion and the dampening effect needed, it has been found that at least a pair of springs having a low "spring index" should be mounted across the central axis of the device 10, with the centers of the springs spaced between about 5 to 10 inches apart. When the springs are spaced more than about 10 inches apart, the resulting torque acting on the support channel and connection to the underlying support surface, resulting from a force delivered to the bag, is significant and can result in early failure of the channel and/or the fasteners. When the springs are placed too close, there is a tendency for the bag to oscillate in a circular motion after being struck.

By employing the frictional forces created by the various components such as the bolt 40, the channel 30, and the bracket support 32, and using springs having a low "spring index," the vibrations of the springs 34 are quickly clamped. As mentioned, most manufacturers of industrial springs define the spring index as the ratio of the diameter of the spring coil to the diameter of the wire comprising the coil. Applicant has determined that the spring index for the present invention to function properly should be about 4.0 to 7.0, preferably about 5.0 to about 6.5. For example, it has been found that a pair of springs having about 18 coils, about 9 inches tall, a coil diameter of 2.75 inches, center to center coil spacing of about 7.5 inches, and a wire diameter of 0.5 inches are suitable. For spring indices within the aforementioned range, it has been noted that any blow delivered within the 120°arc will result in the device quickly oscillating in direction 48. It has been further determined that spring indices of less than about 3.0 are too stiff to provide any reaction to blows delivered by students while indices above about 8.0 deliver too little resistance and too much oscillation. Such preferred springs are commercially available and may be obtained, for example, from M.D.I. Traffic Control of Farmington Hill, Ill., as part No. BAU4070.

From a reading of the above, it may now be understood that the present invention provides for realistic training of the martial arts student to promote accurate power strikes necessary in actual combat. The device returns to the upright position quickly in a time essentially shorter than all but the most advanced student can deliver consecutive blows, particularly with the feet. It is responsive to direct blows but provides considerable resistance to blows not delivered within a certain arc. Changes and modifications will become apparent to those with ordinary skill in the art. Thus, it is to be understood that only the preferred embodiment of the invention was disclosed, but it is understood that the such changes and modifications should be interpreted within the scope of the inventive concept as expressed herein.

We claim:

1. A striking device comprising:

a base plate, having a raised central portion and a pair of flanges, adapted to be secured to an immovable support surface;

a support bracket having a centered opening;

a pair of spring assemblies, each having spaced upper and lower ends, said spring assemblies secured at said upper end to said support bracket adjacent said centered opening and secured at said lower ends to said raised central portion of said base plate;

an upright post extending downwardly through said opening and upwardly a predetermined distance above said support bracket, said post secured against vertical movement with respect to said support bracket; and a resilient bag adapted to be struck positioned over a portion of said post extending above said support bracket and secured to said post by means which allow said resilient bag radial movement with respect to said post when struck with a force passing off center of said bag.

2. The striking device of claim 1 in which said spring assembly comprises a pair of springs having a spring index of between about 4.0 and 7.0.

3. The striking device of claim 2 in which the spring index is about 5.5 with a spring coil diameter of about 2.75 inches, said springs being spaced about 7.5 inches apart from coil center to coil center.

4. The striking device of claim 2 in which said device has a dampening response time period of less than about 2 seconds.

5. The striking device of claim 1 in which said post is adjustable vertically with respect to said bracket.

6. The striking device of claim 1 in which said spring assemblies comprise:

a helical spring;

a pair of spring washers respectively abutting the upper and lower ends of said spring;

a first threaded bolt, having a nut and extending through one of said spring washers and through said bracket, such that the bolt secures the upper end of said spring to said bracket; and a second threaded bolt, having a nut and extending through one of said spring washers and through said channel, such that the bolt secures the lower end of said spring to said channel.

7. A martial arts striking device for strengthening the power strikes of martial arts student comprising:

(a) a spring system including:

(i) at least a pair of vertical helical springs spaced about 5 to 10 inches apart with a spring index of between about 4.0 and 7.0, (ii) a support element having a raised central portion and a pair of flanges adapted to be secured to a substantially immovable surface, and (iii) a support bracket spaced above said support element, each end of said springs being fixedly positioned between said support element and said support bracket in an abutting relationship therewith; and (b) a substantially vertically extending support shaft secured at a lower distal end to said support bracket and mounting a striking bag along the upper portion of said shaft, said bag being secured to said post by means which allow radial movement of said bag with respect to said post when struck with a force passing off center of said bag.

* * * * *